US005916857A

United States Patent [19]

Watson et al.

[11] Patent Number: 5,916,857

[45] Date of Patent: Jun. 29, 1999

[54] CLEANING COMPOSITION FOR REMOVING VISCID RESINOUS ORGANIC MATTER

[75] Inventors: Janice T. Watson; John W. Faulk, both of St. Augustine, Fla.

[73] Assignee: Federal Service & Supply, Inc., St. Augustine, Fla.

[21] Appl. No.: 08/971,643

[22] Filed: Nov. 17, 1997

[51] Int. Cl.[6] ..... C11D 1/08; C11D 3/43; C11D 3/44

[52] U.S. Cl. ..... 510/174; 510/170; 510/172; 510/200; 510/201; 510/432; 510/463; 510/506; 510/407

[58] Field of Search ..... 510/170, 174, 510/172, 200, 201, 432, 463, 506, 407

[56] References Cited

U.S. PATENT DOCUMENTS

| | | | |
|---|---|---|---|
| 3,933,674 | 1/1976 | Farnsworth | 252/171 |
| 4,070,303 | 1/1978 | Ohkubo et al. | 252/364 |
| 4,759,860 | 7/1988 | Tanaka et al. | 252/32.5 |
| 4,867,800 | 9/1989 | Dishart et al. | 134/40 |
| 4,934,391 | 6/1990 | Futch et al. | 134/40 |
| 5,011,620 | 4/1991 | Dishart et al. | 252/118 |
| 5,139,616 | 8/1992 | Ling | 163/147 |
| 5,604,193 | 2/1997 | Vlasblom | 510/212 |
| 5,716,457 | 2/1998 | Hayes et al. | 134/26 |
| 5,728,662 | 3/1998 | Vlasblom | 510/130 |

*Primary Examiner*—Mark Kopec
*Assistant Examiner*—Charles Boyer
*Attorney, Agent, or Firm*—Arthur G. Yeager

[57] ABSTRACT

A "stickie" remover cleaning composition consists of aliphatic petroleum distillate, d-limonene, and an aliphatic dibasic acid ester mixture containing approximately 59% dimethyl glutarate, 21% dimethyl adipate, and 20% dimethyl succinate for use in paper mill production. "Stickies" are resinous type organic materials predominately commonly found in de-inked secondary fiber. Secondary fiber is pulp derived from telephone books, computer paper, etc., and are more common in de-inked secondary fiber than in virgin pulp.

4 Claims, No Drawings

CLEANING COMPOSITION FOR REMOVING VISCID RESINOUS ORGANIC MATTER

BACKGROUND OF THE INVENTION

Many commercial products such as hi-impact solvent-based products consisting of chlorinated or aromatic solvents, are currently available for removing viscid matter from the paper roll covers, wires and felts. Some of the currently used products require a long dwell time to facilitate the "stickie" removal, are characterized by low flash point or are corrosive by nature, and consist of environmentally damaging products. If the residue is not removed during the manufacturing process, a buildup accrues on the roll cover, wires and felts thus causing defects in the manufactured product. It would be desirable to formulate a product utilizing shorter dwell times to remove the "stickies", be biodegradable to facilitate product disposal, contain relatively low-hazard constituents, and be priced competitive to the currently used products.

BRIEF SUMMARY OF THE INVENTION

This invention relates generally to a "stickie" remover cleaning composition for use in the paper manufacturing industry, and more particularly, to a solvent composition which removes adhesives, pitch and latex resins (commonly known as "stickies") from the roll covers, wires and felts used in the paper manufacturing process, which composition is biodegradable and low in photochemically reactive Volatile Organic Compound content (VOC).

Accordant with the present invention, a low-hazard, low photochemically reactive VOC, biodegradable cleaner has been formulated. A cleaning composition is provided herein for use as a cleaner type solvent containing approximately 59% dimethyl glutarate, 21% dimethyl adipate, and 20% dimethyl succinate.

The cleaning composition of the present invention is particularly useful for the removal of "stickies" from paper manufacturing machines.

DETAILED DESCRIPTION OF THE INVENTION

In accordance with the invention, the cleaning composition consists of a combination of aliphatic petroleum distillate, d-limonene, and aliphatic dibasic acid ester.

Aliphatic petroleum distillate, commonly known as "Rule 66 approved mineral spirits" is commercially manufactured by numerous petroleum refining companies such as Shell Oil, Exxon, Unocal, Ashland Oil, and others. This product is available on a local basis from distributors such as ChemCentral, Ashland Chemical, Apperson Chemicals, and others. This non halogen containing solvent must have a flash point above 100 degrees F., and have a low aromatic solvent so as to maintain the low photochemically reactive Volatile Organic Compound content of the inventive formulation. This type of solvent may be present in the inventive formulation at a concentration from about 30 to 70 volume percent. Preferably, the concentration of aliphatic petroleum distillate is about 50 volume percent.

D-limonene is a terpene which occurs naturally in all plants. It is a monocyclic unsaturated terpene, which is generally a by-product of the citrus industry, derived from the distilled rind oils of oranges, grapefruits, lemons, and the like. A discussion regarding d-limonene and its derivations from numerous sources is set forth in Kesterson, J. W., "Florida Citrus Oil", Institute of Food and Agricultural Sciences, University of Florida, December 1971. D-limonene is commercially available from Florida Chemical Company and from SMC Glidco Organics. D-limonene may be present in the inventive formulation at a concentration from about 21 to about 45 volume percent. Preferably, the concentration of the d-limonene is about 30 volume percent.

Aliphatic dibasic acid ester according to the present invention is a compound of the formula:

$$CH_3OOC(CH_2)_nCOOCH_3$$

wherein "n" is a number from 1 to 5. Also contemplated by the term "aliphatic dibasic acid ester" is a a mixture of the aliphatic dibasic acid esters. The aliphatic dibasic acid esters suitable for the use according to the present invention include dimethyl malonate, dimethyl succinate, dimethyl glutarate, dimethyl adipate, dimethyl pimelate, and mixtures thereof. Aliphatic dibasic acid ester may be present at a concentration from about 11 to 29 volume percent. Preferably, the concentration is about 20 volume percent. A preferred aliphatic dibasic acid ester is a mixture of dimethyl glutarate, dimethyl adipate, and dimethyl succinate available from Dupont Chemicals of Wilmington, Del. under the product designation "DBE" or "DBE-1". Such ester mixture may contain about 59% dimethyl glutarate, 21% dimethyl adipate, and 20% dimethyl succinate.

EXAMPLE

In use in test cleaning operations, whereby the invention of the cleaning composition was applied to the roll covers, wires and felts by any of the following methods:

1. manual spraying;
2. spray bar with fan type nozzles; and
3. poured onto the wire or felt;

the composition of the invention exhibited a 20–30% increase in cleaning capability over the cleaning capability of the currently used solvent cleaning product; and a dwell time of 20% less than the dwell time of the currently used solvent cleaning products.

This Example may be repeated with similar success by substituting the generically or specifically described ingredients and/or concentrations recited herein for those used in the preceding Example.

From the foregoing description the essential characteristics of this invention can be readily determined. While the invention has been described with reference to the preferred embodiments above, it is to be understood and appreciated that the invention is susceptible to modification, variation and change without departing from the proper spirit and scope including fair meaning of the accompanying claims.

We claim:

1. A cleaning composition consisting essentially of:

a) approximately 30–70% by volume of aliphatic petroleum distillate;

b) approximately 21–45% by volume of d-limonene; and c) approximately 11–29% by volume of aliphatic dibasic acid ester; wherein components a, b, and c are combined to make up about 100% of the composition.

2. The composition of claim 1 for the cleaning of viscid resinous organic matter from machine roll covers, wires and felts in the paper manufacturing industry while maintaining biodegradability and low photochemically reactive Volatile Organic Compound content consisting of:

about 50 volume percent aliphatic petroleum distillate;

about 30 volume percent d-limonene; and about 20 volume percent aliphatic dibasic acid ester.

3. A cleaning composition to clean viscid resinous organic matter from machine roll covers, wires and felts in the paper manufacturing industry while maintaining biodegradability and low photochemically reactive Volatile Organic Compound content consisting essentially of:

from about 30 to about 70 volume percent aliphatic petroleum distillate;

from about 21 to about 45 volume percent d-limonene; and from about 11 to about 29 volume percent aliphatic dibasic acid ester; wherein the above components are combined to make up about 100% of the composition.

4. A composition for cleaning viscid resinous organic material from surfaces of paper manufacturing machinery; said composition comprising about 50 volume percent aliphatic petroleum distillate; about 30 volume percent d-limonene; and about 20 volume percent aliphatic dibasic acid ester.

* * * * *